US010933260B2

(12) United States Patent
Nance et al.

(10) Patent No.: US 10,933,260 B2
(45) Date of Patent: Mar. 2, 2021

(54) MESH HARNESS SYSTEMS

(71) Applicants: Christopher Andrew Nance, Highland, UT (US); Thomas Zebulon Franke, Salt Lake City, UT (US); Brendan Perkins, Salt Lake City, UT (US)

(72) Inventors: Christopher Andrew Nance, Highland, UT (US); Thomas Zebulon Franke, Salt Lake City, UT (US); Brendan Perkins, Salt Lake City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 204 days.

(21) Appl. No.: 16/125,668

(22) Filed: Sep. 8, 2018

(65) Prior Publication Data

US 2020/0078615 A1 Mar. 12, 2020

(51) Int. Cl.
*A62B 35/00* (2006.01)

(52) U.S. Cl.
CPC ..... *A62B 35/0006* (2013.01); *A62B 35/0012* (2013.01); *A62B 35/0025* (2013.01)

(58) Field of Classification Search
CPC ..... A62B 35/0006; A62B 35/0012; A62B 35/0025
See application file for complete search history.

(56) References Cited

U.S. PATENT DOCUMENTS

| | | | | |
|---|---|---|---|---|
| 5,615,750 | A * | 4/1997 | Phillips | A62B 35/0031 182/6 |
| 5,901,632 | A * | 5/1999 | Ryan | D07B 1/025 87/13 |
| 7,490,610 | B2 * | 2/2009 | Franklin | A62B 35/0025 128/869 |
| 7,743,885 | B2 * | 6/2010 | Martin | A45F 3/12 182/230 |
| 9,144,711 | B2 * | 9/2015 | Walker | A62B 1/16 |
| 10,143,865 | B2 * | 12/2018 | Franke | A62B 35/0025 |
| 2009/0026012 | A1 | 1/2009 | Petzl | |
| 2010/0300803 | A1 * | 12/2010 | Rinklake | A62B 35/0006 182/3 |

(Continued)

FOREIGN PATENT DOCUMENTS

WO 0228482 11/2002

*Primary Examiner* — Colleen M Chavchavadze
(74) *Attorney, Agent, or Firm* — Trent Baker; Baker IP PLLC

(57) ABSTRACT

One embodiment of the present invention is related to a harness system including a waist member and a leg loop member. The two leg loop members are configured to encircle the legs of the user and are coupled to the waist member. The leg loop members each comprise a net-leg region, a waist coupling region, and two net-waist transition regions. The net-leg region comprises a load bearing net structure having a plurality of independent recesses defined by an intercoupled mesh material. The waist member may also include a similar net-waist region, leg coupling region, and two net-leg transition regions. The net-leg and net-waist regions may include at least one of edge tape, shape mesh, proximal fabric, and distal fabric. The net-waist transition regions and the net-leg transition regions may comprise either a non-stitch transition or a stitch coupling to the waist and leg coupling regions respectively.

20 Claims, 8 Drawing Sheets

(56) References Cited

U.S. PATENT DOCUMENTS

| | | | | |
|---|---|---|---|---|
| 2013/0139741 | A1* | 6/2013 | Fields | D07B 1/04 114/230.21 |
| 2016/0096043 | A1* | 4/2016 | Blondeau | A62B 35/0025 182/3 |
| 2016/0346571 | A1* | 12/2016 | Huber | A62B 35/0012 |
| 2016/0375278 | A1* | 12/2016 | Blondeau | A62B 35/0025 182/3 |

* cited by examiner

MESH HARNESS SYSTEMS

FIELD OF THE INVENTION

The invention generally relates to harnesses systems. In particular, the present invention relates to lightweight mesh harnesses.

BACKGROUND OF THE INVENTION

Harnesses are used to intercouple a user with some form of safety line such as a rope or cable. The most common type of harness used in outdoor sports is coupled around a user's waist and legs. In various outdoor sports, a harness is used during ascent and descent of technical terrain to enable a user to intercouple with a rope. For example, in roped climbing-related activities, an individual will generally wear a harness to provide a coupling point for the rope. Likewise, during roped descents and rappels, a harness is necessary to facilitate the controlled rope descent.

Various types of harnesses are used based on desired performance characteristics corresponding to a particular activity. These characteristics include weight, adjustment range, usability, safety, strength, etc. Most rock climbing and rappelling type harnesses include a waist belt and a set of leg loops interconnected at a frontal location. The waist belt and leg loops must meet certain industry-certified strength parameters while also providing a minimum amount of comfort to the user. For example, the waist belt and leg loops generally include wide regions designed to distribute forces across corresponding anatomical regions of the user.

In many applications, the primary performance characteristic of a harness is the overall weight. The evolution of harnesses has therefore been primarily toward lighter-weight systems, including various stitching and fabric selection techniques to minimize weight while maintaining minimum strength and comfort. For example, heavier materials are often stitched between regions of lightweight narrow materials to maintain comfort but minimize weight. Unfortunately, the technique of stitching multiple materials together still requires heavy stitching to intercouple the regions while maintaining necessary strength.

Other crucial performance characteristics of harness systems relate specifically to the structure and function of the waist belt and leg loop regions. These characteristics include force distribution, breathability, and shape of the waist belt and leg loop regions. The force distribution refers to how a user's waist or leg interacts with the corresponding waist belt or leg loops in loaded circumstances. For example, in harness operational scenarios, a user's weight is dynamically loaded onto the harness via a rope or other safety device. The harness then transfers the force from the rope to the user via the waist belt and leg loops. The points of contact between the user and harness are therefore critical in defining the overall comfort of the harness. Conventional harnesses that optimize weight often sacrifice comfort.

Therefore, there is a need in the industry for a harness system that both minimizes overall weight yet maximizes user comfort via force distribution, breathability, and shape of the leg loops and/or waist belt.

SUMMARY OF THE INVENTION

The present invention relates to harnesses with structural net regions on the leg loops and/or waist belt. One embodiment of the present invention is related to a harness system including a waist member and a leg loop member. The two leg loop members are configured to encircle the legs of the user and are coupled to the waist member. The leg loop members each comprise a net-leg region, a waist coupling region, and two net-waist transition regions. The net-leg region comprises a load bearing net structure having a plurality of independent recesses defined by an intercoupled mesh material. The waist member may also include a similar net-waist region, leg coupling region, and two net-leg transition regions. The net-leg and net-waist regions may include at least one of edge tape, shape mesh, proximal fabric, and distal fabric. The net-waist transition regions and the net-leg transition regions may comprise either a non-stitch transition or a stitch coupling to the waist and leg coupling regions, respectively. A second embodiment of the present invention relates to a method of manufacturing a harness with a net structure on the leg loops and/or waist belt.

Embodiments of the present invention represent a significant advancement in the field of harnesses systems. Conventional lightweight harnesses fail to significantly minimize weight while maintaining optimal comfort and strength. Embodiments of the present invention incorporate net regions which provide even load distribution, breathability, and variable width. The net regions may be located on the leg loops and/or the waist belt to optimize comfort while minimizing weight. Conventional lightweight harness systems utilize webbing, cord, or warp yarn (see prior art figures) but fail to provide the optimal comfort of the net-based embodiments of the present invention.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
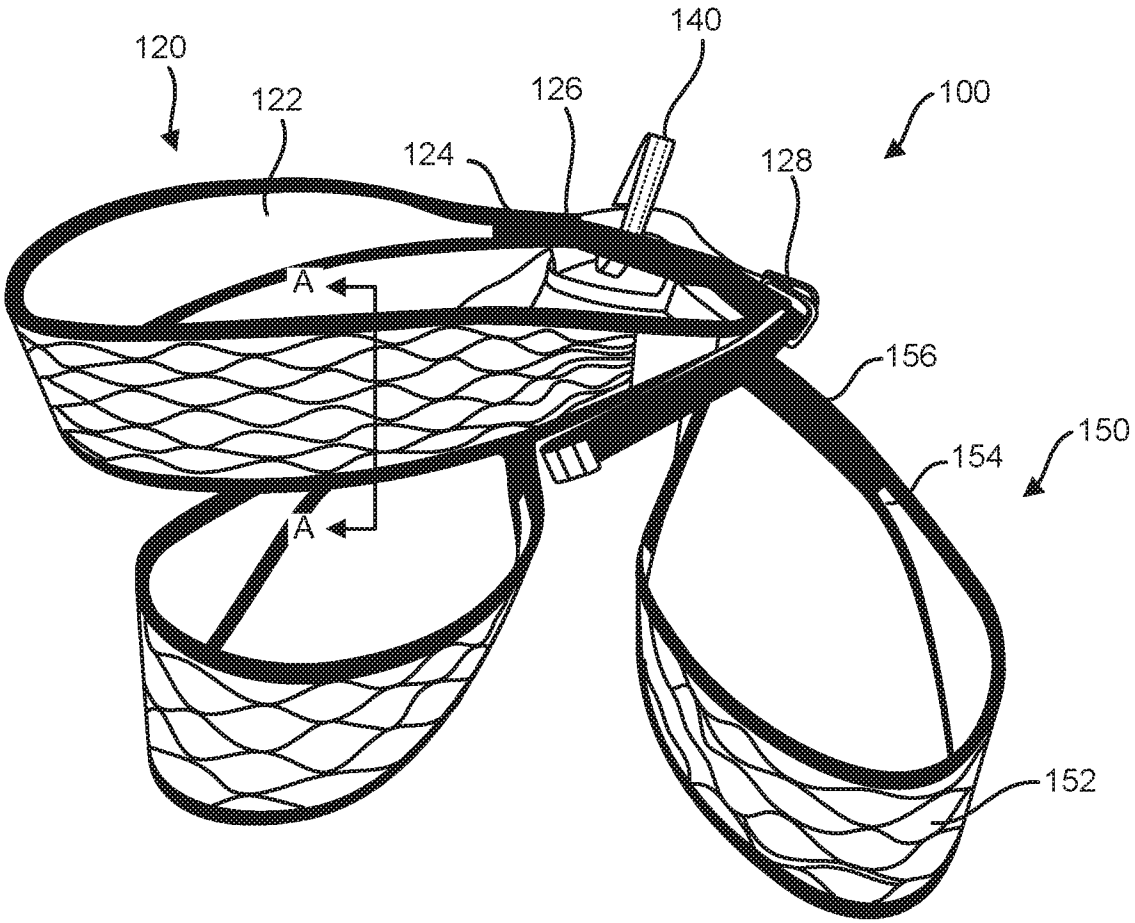
FIG. 1 illustrates a harness system in accordance with embodiments of the present invention.

The present invention relates to harnesses with structural net regions on the leg loops and/or waist belt. One embodiment of the present invention is related to a harness system including a waist member and a leg loop member. The two leg loop members are configured to encircle the legs of the user and are coupled to the waist member. The leg loop members each comprise a net-leg region, a waist coupling region, and two net-waist transition regions. The net-leg region comprises a load bearing net structure having a plurality of independent recesses defined by an intercoupled mesh material. The waist member may also include a similar net-waist region, leg coupling region, and two net-leg transition regions. The net-leg and net-waist regions may include at least one of edge tape, shape mesh, proximal fabric, and distal fabric. The net-waist transition regions and the net-leg transition regions may comprise either a non-stitch transition or a stitch coupling to the waist and leg coupling regions, respectively. A second embodiment of the present invention relates to a method of manufacturing a harness with a net structure on the leg loops and/or waist belt. Also, while embodiments are described in reference to a harness, it will be appreciated that the teachings of the present invention are applicable to other areas.

The following terms are defined as follows:

Net—a structure having a plurality of independent recesses defined by an intercoupled mesh material. For example, a basketball net, soccer net, fishing net, etc. are all net structures commonly composed of interwoven string or cord which positively define a mesh and negatively define a plurality of independent recesses. The independent recesses may be shaped by the mesh in various geometrical orientations such as circles, diamonds, polygons, etc. It will be appreciated that a net or mesh structure is distinct from a woven structure (i.e. webbing), braided structure (i.e. cord), or twisted structure (ie. cable) in that the net or mesh structure does NOT include weaving an orthogonal fiber, braiding three independent fibers, or twisting a plurality of fibers. It will further be appreciated that a net structure may be compressed or knitted such that the plurality of recesses are positioned together without any type of weaving while maintaining the net structure. A compressed or knitted net may appear similar to webbing since the independent recesses are not visible but the compressed net will not comprise any type of orthogonal weaving.

Weaving—a type of interweaving in which an orthogonal fiber is interwoven between a set of substantially parallel fibers.

Webbing—an elongated flat member comprising a set of woven fibers. For example, a common type of webbing comprises colored nylon.

Cord—an elongated member comprising a set of at least three braided fibers.

Cable—an elongated member comprising a single strand or a plurality of twisted non-braided strands.

Net transition region—a continuous transition between a net structure region and an alternative type of structure including but not limited to a compressed net, webbing, cord, or cable (as defined above). A transition region may include at least one of compressing, knitting, orthogonal stitching, and weaving.

Reference is initially made to FIG. 1, which illustrates a harness system, designated generally at 100. The harness system 100 includes a waist member 120, a set of leg loop members 150, and an intercoupler 140. It will be appreciated that the illustrated set of two leg loop members 150 are substantially similar and therefore will be described individually for purposes of readability. The waist member 120 forms a continuous loop configured to encircle the waist region of a user. The term "continuous loop" refers to a mathematically continuous shape that does not substantially include any points of discontinuity. The leg loop members 150 substantially encircle the upper leg regions of the user (not shown). The waist member 120 may include various non-illustrated conventional harness components unrelated to the present invention, including but not limited to gear loops, rear loop adjustment mechanisms, adjustable leg loop height mechanisms, etc. The illustrated coupler 140 extends around both the waist member 120 and leg loop members 150. Various other optional well-known optional straps or systems may be incorporated in the harness system 100 in accordance with embodiments of the present invention. Although the illustrated harness system 100 in FIG. 1 incorporates a net structure in both the waist member 120 and leg loop members 150, it will be appreciated that embodiments may include a net structure in either the waist member 120 or leg loop members 150 only.

The illustrated waist member 120 further includes a net-waist region 122, a net-leg transition region 124, a leg coupler 126, and an optional waist adjustable buckle 128. The net-waist region 122 is illustrated as the expanded medial portion of the waist member 120. The net-waist region 122 is configured to receive and distribute a substantial portion of any forces on the waist member 120 to the user's low back and/or hips. It is desirable for the net-waist region 122 to include an increased width versus the remainder of the waist member 120 so to vertically distribute forces while maintaining desirable comfort. Although the illustrated net-waist region 122 includes a relatively uniform curved expansion and tapered width shape (i.e. wider in the middle and tapered on the ends), it will be appreciated that the width shape may include additional expansion shapes for increased comfort in accordance with the properties of the net structure (described in further detail with reference to FIGS. 2A-B). The thickness of the net-waist region 122 is substantially uniform and dependent on the type and number of layers (described in further detail with reference to FIGS. 3A-G). The length of the net-waist region 122 is substantially fixed between the two net-leg transition regions 124. The illustrated leg couplers 126 are disposed on either side of the net-waist region 122 with the net-leg transition regions 124 therebetween. The illustrated leg couplers 126 are webbing type regions comprising an orthogonal woven fiber. The net-leg transition regions 124 comprise at least one of a stitch or non-stitch transition (described in further detail with reference to FIGS. 4A-B and FIGS. 5A-B). The illustrated leg couplers 126 are intercoupled with one another through a waist adjustable buckle 128 which enables a user to adjust the circumference of the continuous loop formed by the waist member 120 around the user's waist. It will be appreciated that the waist adjustable buckle 128 is an optional component and may be replaced with some type of direct coupling between the two leg couplers 126 of the waist member 120 in accordance with contemplated non-illustrated embodiments.

The illustrated leg loop members 150 each further includes a net-leg region 152, a net-waist transition region 154, a waist coupler 156, and an optional waist adjustable buckle. The net-leg region 152 is illustrated as the expanded medial portion of the leg loop member 150. The net-leg region 152 is configured to receive and distribute a substantial portion of any forces on the leg loop member 150 to the user's upper leg region. It is desirable for the net-leg region 152 to include an increased width versus the remainder of the leg loop member 120 to vertically distribute forces while maintaining desirable comfort. Although the illustrated net-leg region 152 includes a relatively uniform curved expansion and tapered width shape (i.e. wider in the middle and tapered on the ends), it will be appreciated that the width shape may include additional expansion shapes for increased comfort in accordance with the properties of the net structure (described in further detail with reference to FIGS. 2A-B). The thickness of the net-leg region 152 is substantially uniform and dependent on the type and number of layers (described in further detail with reference to FIGS. 3A-G). The length of the net-leg region 152 is substantially fixed between the two net-waist transition regions 154. The illustrated waist couplers 156 are disposed on either side of the net-leg region 152 with the net-waist transition regions 154 therebetween. The illustrated waist couplers 156 are webbing type regions comprising an orthogonal woven fiber. The net-waist transition regions 154 comprise at least one of a stitch or non-stitch woven transition (described in further detail with reference to FIGS. 4A-B and FIGS. 5A-B). The illustrated waist couplers 156 are intercoupled with one another through an adjustable leg buckle, which enables a user to adjust the circumference of each of the continuous loops formed by the leg loop members 150 around the user's legs. It will be appreciated that the leg adjustable buckles are an optional component and may be replaced with some type of direct coupling between the two waist couplers 156 of the leg loop members 150 in accordance with contemplated non-illustrated embodiments.

Figure 2A:
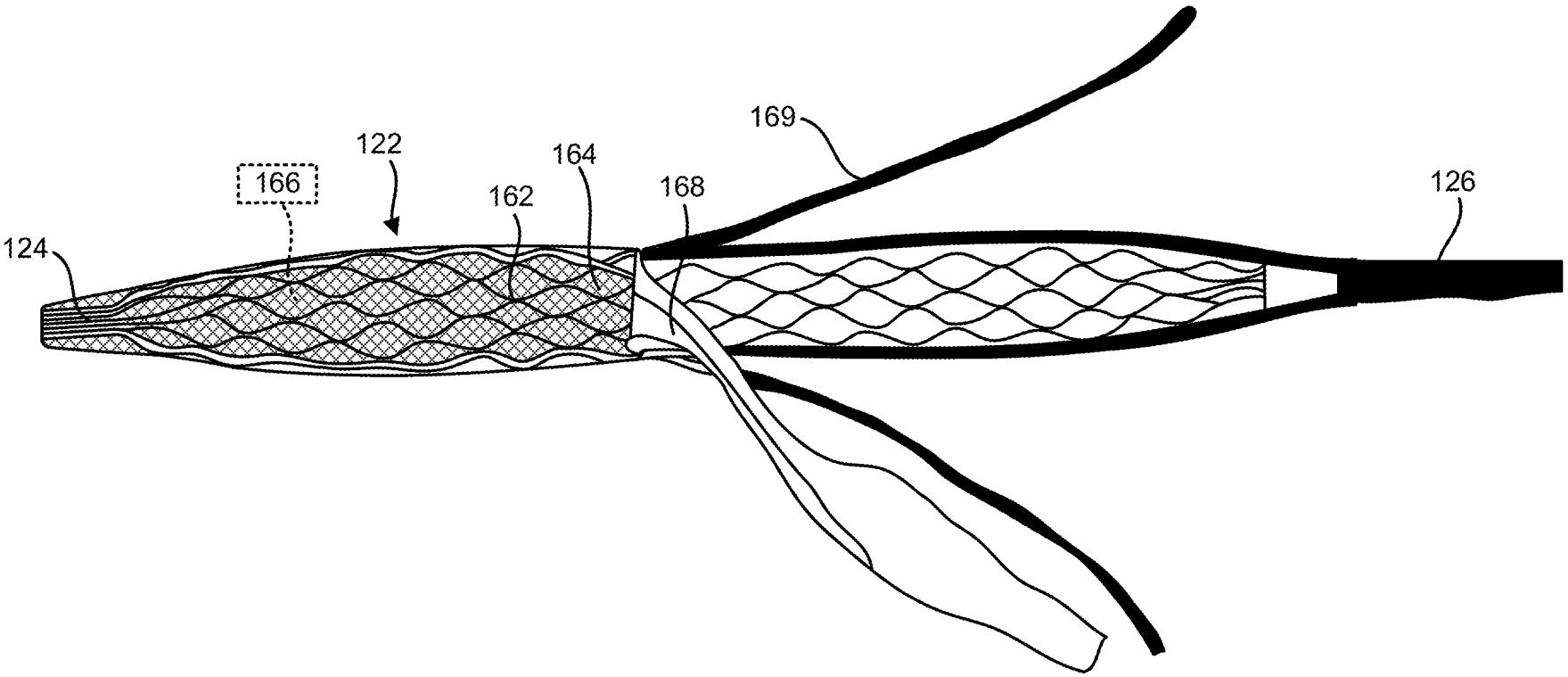
FIGS. 2A-B illustrates net-waist regions 122 in accordance with embodiments of the present invention.
Figure 2B:
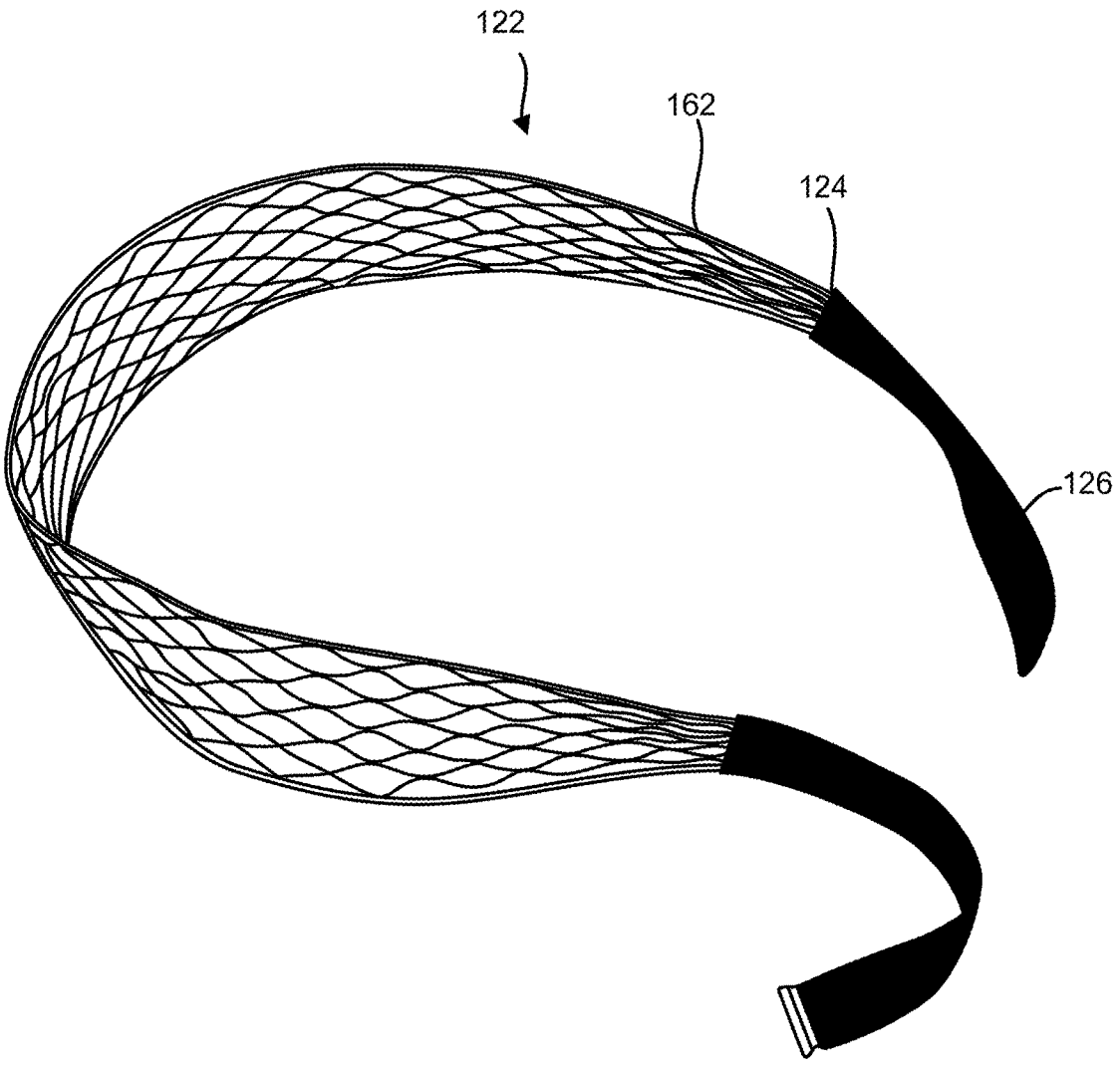

Reference is next made to FIGS. 2A-B which illustrate embodiments of the waist member 120. As described above, the following technical description of components of the net-waist region 122 may be applied to the net-leg regions 152. Likewise, the net-leg regions 152 of a harness system 100 may incorporate alternative structural embodiments from the net-waist region 122. For example, the net-waist region 122 may incorporate the net structure embodiment illustrated in FIG. 2A, while the net-leg regions 152 may incorporate the net structure embodiment illustrated in FIG. 2B. FIG. 2A illustrates a partial deconstructed view of a net-waist region 122, waist-leg transition region 124, and a leg coupler 126 further including a net structure 162, a shape mesh 164, a proximal fabric 166, a distal fabric 168, and a set of edge tape 169. It will be appreciated that corresponding structures (not illustrated) may be incorporated into a net-leg region 152 as net structure, shape mesh, proximal fabric, distal fabric, and a set of edge tape 179. Various combinations of these components may be incorporated into alternative embodiments of the present invention and are described in reference to FIGS. 3A-G. The only required and structural element of the net-waist 122 is the net structure 162. As defined above, the net structure 162 is a structure having a plurality of independent recesses defined by an intercoupled mesh material. The net structure 162 is a novel lightweight structural element that effectively creates the necessary force tolerances while optimizing user comfort and breathability through width expansion. The shape mesh 164 is a non-structural optional component which supports the width shape of the net structure 164. The shape mesh 164 may include a fabric member with a weave that is substantially tighter than the net structure 162. The shape mesh 164 may act as a backing upon which the net structure 162 could be glued, laminated, or otherwise retained. The proximal and distal fabrics 166, 168 are non-structural optional fabric members which may be disposed on the proximal and distal sides of the net structure 162 and shape mesh 164 for purposes of durability and protection. Likewise, the set of edge tape 169 includes two non-structural optional members positioned above and below the net structure 162 and shape mesh 164 in a manner to protect the layers from abrasion. The illustrated waist member 120 includes an exposed net-leg transition region 124 with a non-stitched transition (described in more detail in reference to FIG. 4B). The illustrated leg coupler 126 is a woven webbing fabric. FIG. 2B illustrates an alternative simplified embodiment of the waist member 120 including a net-waist region 122 which comprises only a net structure 162. As described above, the net structure 162 is the only required and structural component of the net-waist 152 or net-leg regions.

Figure 3A:
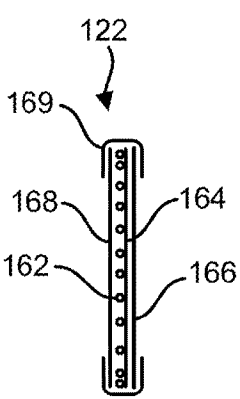
FIGS. 3A-G illustrate cross-sectional views of alternative net-waist regions 122 along the line A-A in FIG. 1 in accordance with embodiments of the present invention.
Figure 3B:
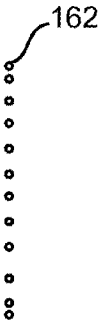
Figure 3C:
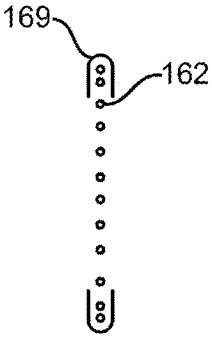
Figure 3D:
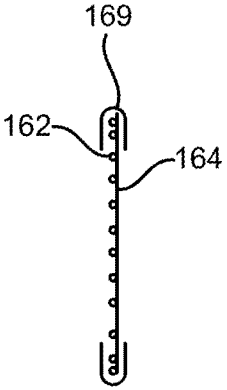
Figure 3E:
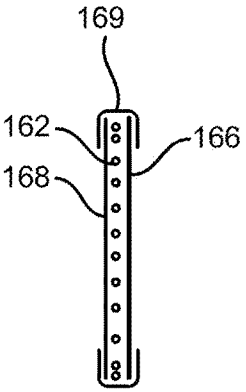
Figure 3F:
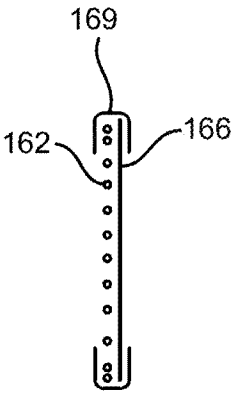
Figure 3G:
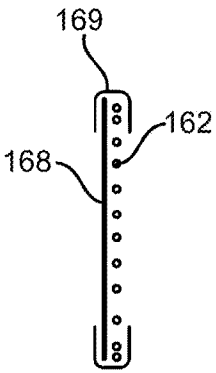

Reference is next made to FIGS. 3A-G which illustrate alternative cross-sectional view embodiments of the net-waist region 122 or net-leg region of the waist member 120 or leg loop members 150 in accordance with embodiments of the present invention. FIG. 3A illustrates the embodiment of the net-waist region 122 illustrated in FIG. 2A including both the structural and non-structural optional components of the net structure 162, shape mesh 164, proximal fabric 166, distal fabric 168, and set of edge tape 169. The cross-sectional illustration shows the relative positions of the components for optimal performance. As described above, the non-structural optional components are primarily used for durability and shape retention rather than any type of load distribution. Various types of non-structural intercouplings between the components may be used including but not limited to gluing, stitching, weaving, etc. FIG. 3B illustrates the embodiment of the net-waist region 122 illustrated in FIG. 2B including only the net structure 162 as the structural component of the net-waist region 122. Likewise, FIGS. 3C-G illustrate alternative combinations of the structural and non-structural optional components which may be selected to further reduce weight or cost of the harness system 100 while maintaining the necessary structural tolerances.

Figure 4A:
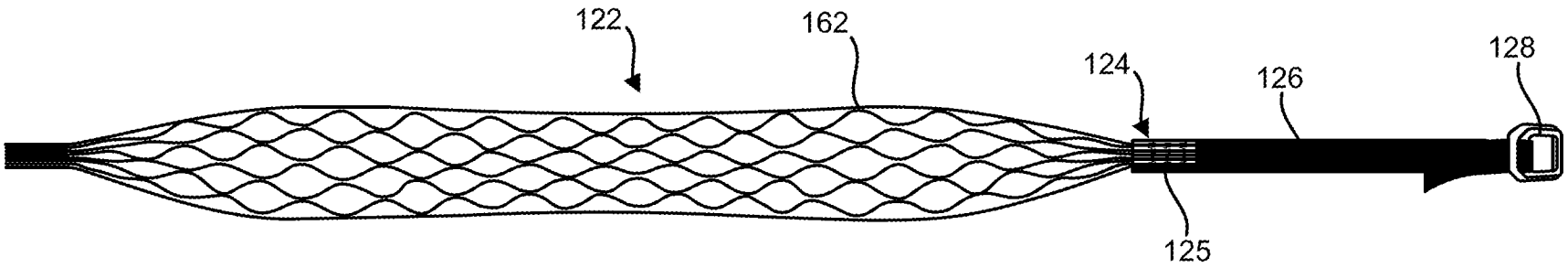
FIGS. 4A-B illustrate net-waist regions 122 with alternative waist-leg transition regions 126 in accordance with embodiments of the present invention.
Figure 4B:
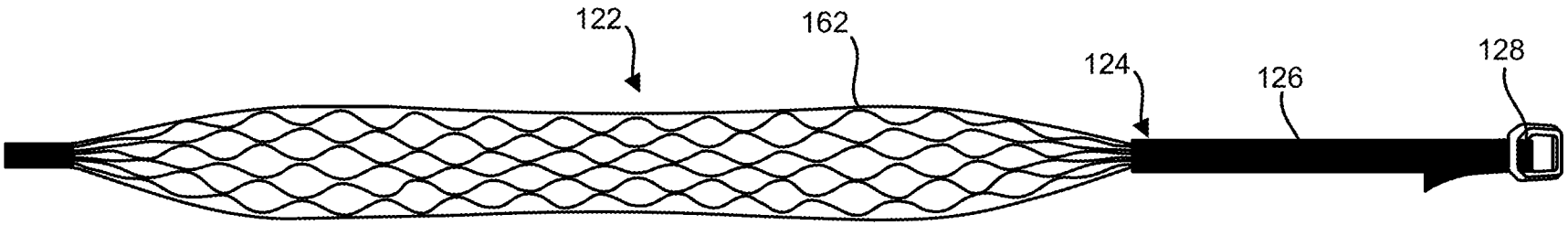

Reference is next made to FIG. 4A-B, which illustrate two embodiments of the waist-leg or leg-waist transition regions 124, 154 of the waist loop or leg loops 120, 150. FIG. 4A illustrates a waist loop 120 with a net-waist region 122 comprising only a net structure 162, a waist-leg transition 124, a leg coupler 126, and a waist adjustable buckle 128. The illustrated waist-leg transition 124 in FIG. 4A includes a set of orthogonal stitches 125, thereby making the waist-leg transition 124 a stitch-based transition. The orthogonal stitches 125 are well known stitches which extend through both the net structure 162 and webbing material of the leg coupler 126, so as to secure the members together in a lengthwise manner. This conventional coupling technique is used on many load bearing fabric systems including harnesses. The illustrated waist-leg transition 224 in FIG. 4B includes a non-stitch transition between the net structure 162 and the material of the leg coupler 126, thereby creating a non-stitch-based transition.

Figure 5B:
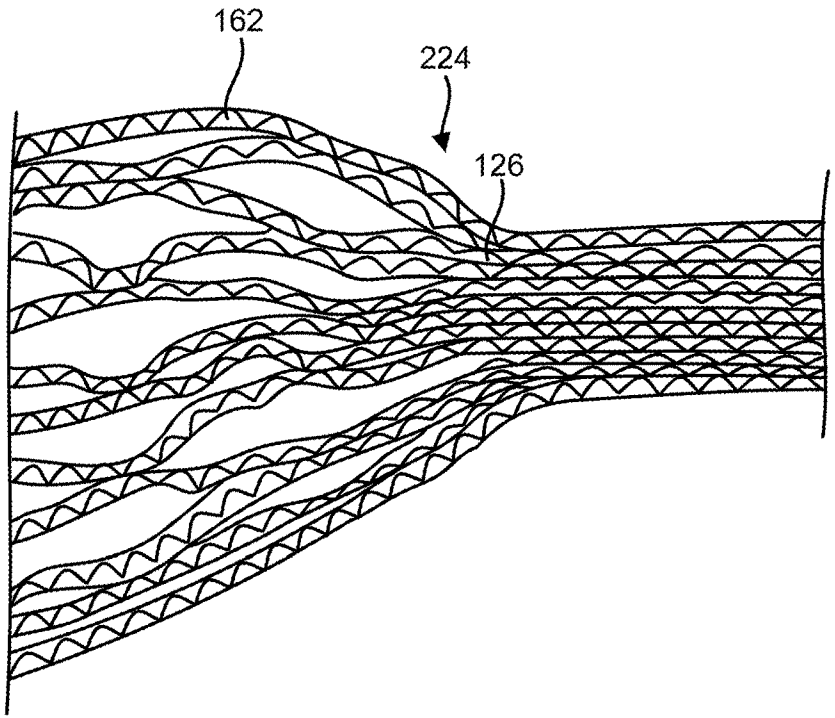
FIGS. 5A-B illustrates alternative non-stitch transition regions 224 between the net structure 162 and a leg coupler 126 in accordance with embodiments of the present invention.
Figure 5A:
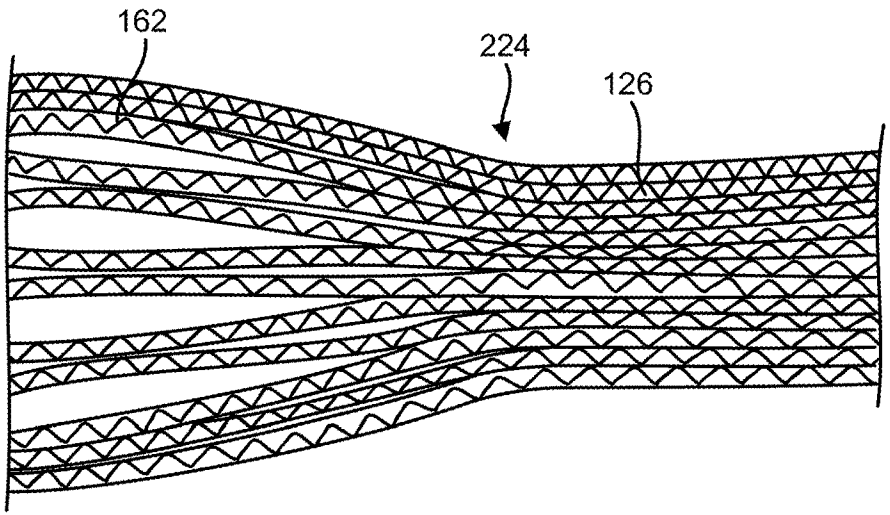

Reference is next made to FIGS. 5A-B, which illustrate two embodiments of a non-stitch waist-leg transition 224 as shown in FIG. 4B. It will be appreciated that the non-stitch embodiments shown may also be applied to a leg-waist transition region (not shown). FIG. 5A illustrates a non-stitch crochet knitting transition region 224 between a net structure 162 and a leg loop coupler 126. FIG. 5B illustrates a non-stitch warp knitting transition region 224 between a net structure 162 and a leg loop coupler 126.

Figure 6A:
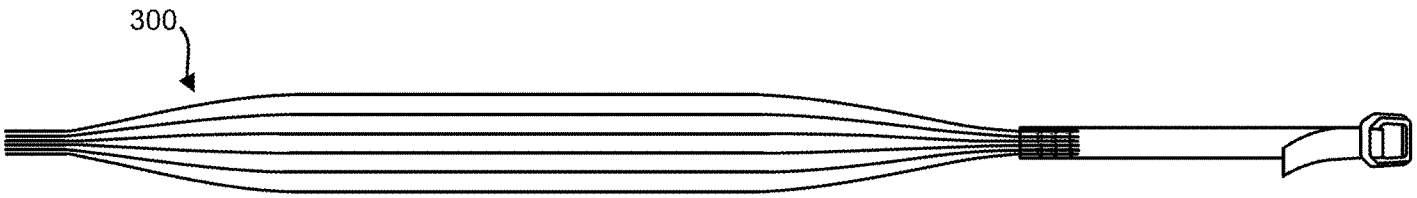
(PRIOR ART) FIG. 6A
FIGS. 6A-G illustrate various prior art structural coupling systems or transition regions between various structural components.
Figure 6B:
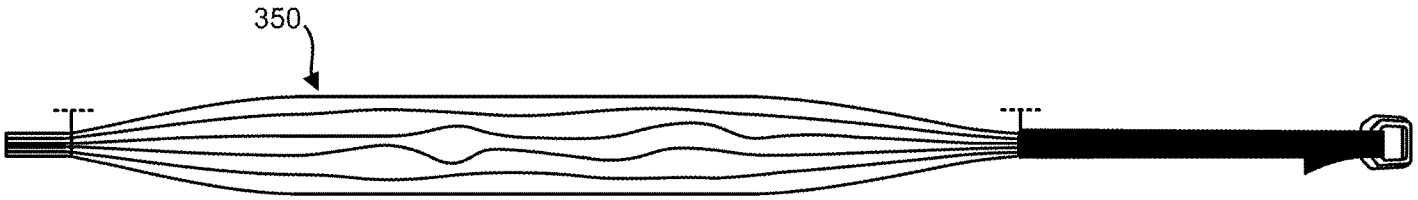
(PRIOR ART) FIG. 6B
Figure 6C:
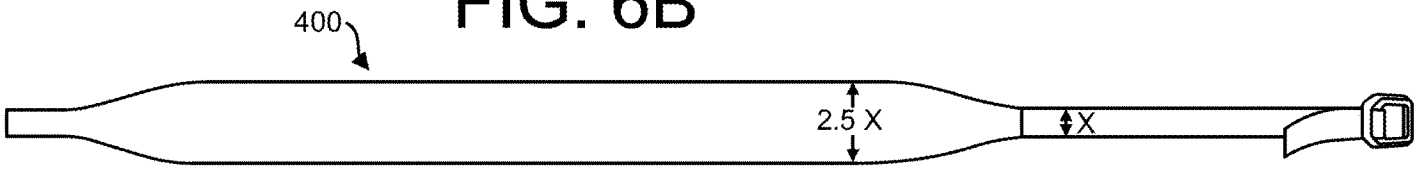
(PRIOR ART) FIG. 6C
Figure 6D:
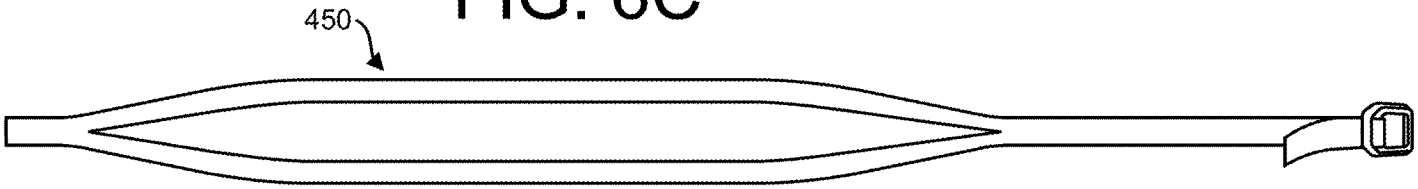
(PRIOR ART) FIG. 6D
Figure 6E:
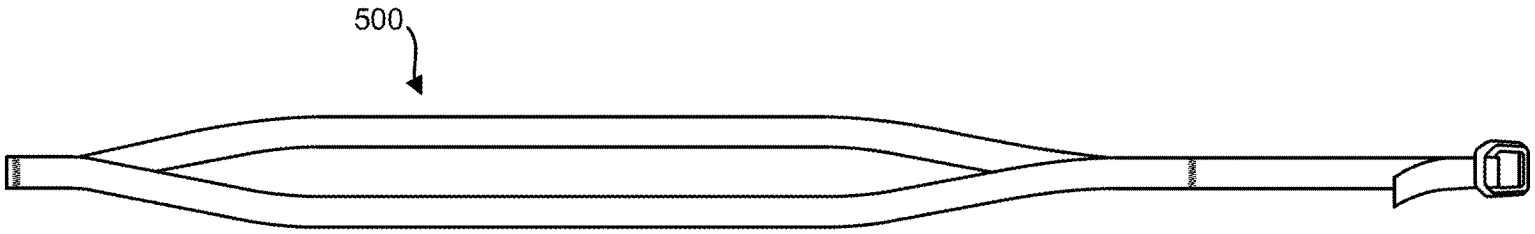
(PRIOR ART) FIG. 6E
Figure 6F:
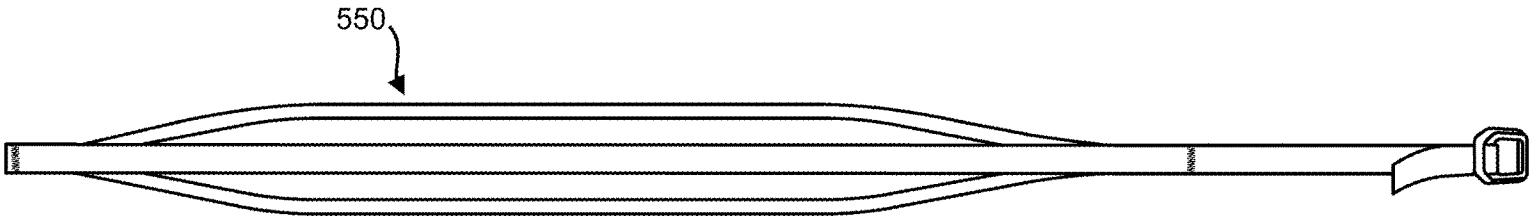
(PRIOR ART) FIG. 6F
Figure 6G:
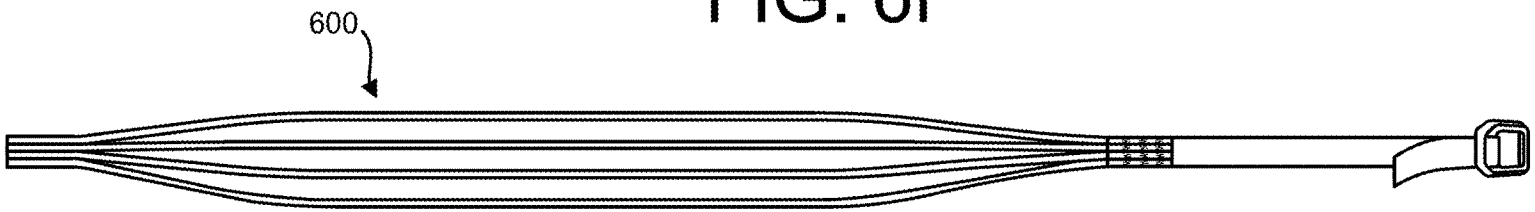
(PRIOR ART) FIG. 6G

Reference is next made to FIGS. 6A-G which illustrate various prior art waist member or leg loop member configurations designated generally at 300, 350, 400, 450, 500, 550, 600. FIG. 6A illustrates a waist/leg member 300 that includes a plurality of braided cords oriented in a parallel expanded region stitch coupled to a piece of webbing. As defined above, a braided cord comprises at least three fibers interwoven versus a net structure which negatively defines a plurality of recesses between a mesh shape. FIG. 6B illustrates a waist/leg member 350 that includes a plurality of warp yarn non-uniformly spread out in an expanded region coupled to a woven webbing member. The transition between the expanded region and the webbing includes severing the weft yarn and orthogonally stitching the remaining warp and weft to form the woven webbing member. FIG. 6C illustrates a waist/leg member 400 that includes a piece of vari-width webbing forming both the expanded and coupler portions. It is well known that an expanded region of vari-width webbing is limited in width to 2.5× the width of the narrower region. FIG. 6D illustrates a waist/leg member 450 that includes splitting a piece of webbing to form the expanded region and laterally joining the webbing to form the coupler regions. FIG. 6E illustrates a waist/leg member 500 that includes two pieces of webbing forming the expanded region and overlaying the two pieces of webbing with a stitch coupling to form the coupler regions. FIG. 6F illustrates a waist/leg member 550 that includes three pieces of webbing to form the expanded region and overlaying the three pieces of webbing with a stitch coupling to form the coupler regions. FIG. 6G illustrates a waist/leg member 600 that includes four pieces of webbing forming the expanded region and overlaying the four pieces of webbing with a stitch coupling to form the coupler regions.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. A harness system comprising:

a waist member configured to encircle the naval region of a user, wherein the waist member forms a continuous waist loop;

two leg loop members configured to encircle the legs of the user, wherein the leg loop members are coupled to the waist member; and wherein the leg loop members each comprise a net-leg region, a waist coupling region, and two net-waist transition regions, wherein the net-leg region comprises a load bearing net structure having a plurality of independent recesses defined by an intercoupled mesh material.

2. The system of claim 1, wherein the waist member further includes a net-waist region, leg coupling region, and two net-leg transition regions, and wherein the net-waist region comprises a load bearing net structure having a plurality of independent recesses defined by an intercoupled mesh material.

3. The system of claim 2, wherein the waist member further includes an adjustable buckle on the leg coupling region configured to adjust to length of the leg coupling region.

4. The system of claim 1, wherein the leg loop members each further include an adjustable buckle on the waist coupling region configured to adjust the length of the waist coupling region.

5. The system of claim 1, wherein the net-leg regions further includes at least one of edge tape, shape mesh, proximal fabric, and distal fabric.

6. The system of claim 2, wherein the net-waist region further includes at least one of edge tape, shape mesh, proximal fabric, and distal fabric.

7. The system of claim 1, wherein the two net-waist transition regions comprise a stitch coupling to the waist coupling region.

8. The system of claim 1, wherein the two net-waist transition regions comprises a non-stitch transition to the waist coupling region.

9. The system of claim 2, wherein the net-leg transition region comprises a stitch coupling to the leg coupling region.

10. The system of claim 2, wherein the net-leg transition region comprises a non-stitch transition to the leg coupling region.

11. The system of claim 1, wherein the two leg loop members are coupled to the waist member via an intercoupler.

12. A harness system comprising:

a waist member configured to encircle the naval region of a user, wherein the waist member forms a continuous waist loop;

two leg loop members configured to encircle the legs of the user, wherein the leg loop members are coupled to the waist member;

wherein the leg loop members each comprise a net-leg region, a waist coupling region, and two net-waist transition regions, wherein the net-leg region comprises a load bearing net structure having a plurality of independent recesses defined by an intercoupled mesh material, and wherein the two net-waist transition regions comprise one of a stitch coupling and a non-stitch transition to the waist coupling region; and wherein the waist member further includes a net-waist region, leg coupling region, and two net-leg transition regions, wherein the net-waist region comprises a load bearing net structure having a plurality of independent recesses defined by an intercoupled mesh material, and wherein the net-leg transition region comprises one of a stitch coupling and a non-stitch transition to the leg coupling region.

13. The system of claim 12, wherein the net-waist regions further include at least one of edge tape, shape mesh, proximal fabric, and distal fabric.

14. The system of claim 12, wherein the net-leg region further includes at least one of edge tape, shape mesh, proximal fabric, and distal fabric.

15. The system of claim 12, wherein the waist member further includes an adjustable buckle on the leg coupling region configured to adjust to length of the leg coupling region.

16. The system of claim 12, wherein the leg loop members each further include an adjustable buckle on the waist coupling region configured to adjust the length of the waist coupling region.

17. The system of claim 12, wherein the two leg loop members are coupled to the waist member via an intercoupler.

18. A method for manufacturing a harness leg loop comprising the acts of:

providing a harness system comprising a waist member configured to encircle the naval region of a user and two leg loop members configured to encircle the legs of the user, wherein the leg loop members are coupled to the waist member;

constructing the leg loop members with a net-leg region, a waist coupling region, and two net-waist transition regions, and constructing the net-leg region to comprise a load bearing net structure having a plurality of independent recesses defined by an intercoupled mesh material.

19. The method of claim 18 further including the act of constructing the waist member with a net-waist region, leg coupling region, and two net-leg transition regions, constructing the net-waist region to comprise a load bearing net structure having a plurality of independent recesses defined by an intercoupled mesh material, and constructing the net-leg transition region to comprise one of a stitch coupling and a non-stitch transition to the leg coupling region.

20. The system of claim 18, wherein the act of constructing the leg loop members further includes constructing the two net-waist transition regions to comprise one of a stitch coupling and a non-stitch transition to the waist coupling region.

* * * * *